US008720866B1

(12) United States Patent
Gibbs

(10) Patent No.: US 8,720,866 B1
(45) **Date of Patent: *May 13, 2014**

(54) BARRIER SYSTEM

(71) Applicant: Edward L. Gibbs, Tulsa, OK (US)

(72) Inventor: Edward L. Gibbs, Tulsa, OK (US)

(73) Assignee: Ameristar Perimeter Security USA Inc., Tulsa, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/773,599

(22) Filed: Feb. 21, 2013

Related U.S. Application Data

(63) Continuation of application No. 13/177,594, filed on Jul. 7, 2011, now Pat. No. 8,382,070.

(51) Int. Cl.
*E04H 17/24* (2006.01)

(52) U.S. Cl.
USPC ..... 256/65.02; 256/67; 256/DIG. 5

(58) Field of Classification Search
USPC ..... 256/67, 72, 65.02, 65.03, 59, 21, 22, 256/DIG. 5
See application file for complete search history.

(56) References Cited

U.S. PATENT DOCUMENTS

| | | | | | |
|---|---|---|---|---|---|
| 91,310 | A * | 6/1869 | DeGroat | 256/21 |
| 1,498,127 | A * | 6/1924 | Sommer | 256/21 |
| 2,346,111 | A * | 4/1944 | MacKenzie | 256/67 |
| 2,520,313 | A * | 8/1950 | Harris | 256/22 |
| 2,642,269 | A * | 6/1953 | Daniel | 256/21 |
| 2,870,996 | A * | 1/1959 | Helt | 256/22 |
| 3,902,703 | A * | 9/1975 | Bouye | 256/24 |
| 4,455,806 | A * | 6/1984 | Rice | 52/404.1 |
| 5,120,025 | A * | 6/1992 | D'Avanzo | 256/22 |
| 5,277,408 | A * | 1/1994 | Parker | 256/65.02 |
| 5,657,967 | A * | 8/1997 | Patrick | 256/19 |
| 5,681,030 | A * | 10/1997 | Nall | 254/30 |
| 6,010,117 | A * | 1/2000 | Doxey | 256/73 |
| 6,866,253 | B1 * | 3/2005 | Hopper | 256/65.09 |
| 6,874,767 | B1 * | 4/2005 | Gibbs | 256/65.08 |
| 7,347,412 | B1 * | 3/2008 | Zhu | 256/22 |
| 7,475,868 | B1 * | 1/2009 | Gibbs | 256/23 |
| 7,651,073 | B1 * | 1/2010 | Gibbs | 256/59 |
| 7,942,384 | B1 * | 5/2011 | Gibbs | 256/1 |
| D655,826 | S * | 3/2012 | Gibbs | D25/121 |
| 8,382,070 | B1 * | 2/2013 | Gibbs | 256/65.02 |
| 2003/0132426 | A1 * | 7/2003 | Kang | 256/22 |
| 2007/0221902 | A1 * | 9/2007 | Kerr | 256/22 |
| 2009/0179183 | A1 * | 7/2009 | Ferris et al. | 256/67 |
| 2010/0200825 | A1 * | 8/2010 | Hill | 256/24 |
| 2010/0288989 | A1 * | 11/2010 | Williams et al. | 256/59 |

* cited by examiner

*Primary Examiner* — Joshua Kennedy
(74) *Attorney, Agent, or Firm* — Gary Peterson

(57) ABSTRACT

A barrier is formed from a plurality of posts and a plurality of rails. Each post has an I-shaped cross section, with a pair of double-walled flanges separated by a single-walled web. Each rail is a channel-shaped member having an intermediate portion and opposed end portions. Each end portion has a rounded convex edge. The intermediate portion includes a flat section to which pickets or a fencing fabric may be attached. Each end portion also includes a flat section, which is recessed relative to the flat section of the intermediate portion. A rail is connected to a post by inserting the rail's end portion into the channel-shaped region of the post. The flat section of the rail's end portion engages the planar inner side of one of the post's flanges. Fasteners are inserted into aligned openings in the flange and the flat section to connect the rail to the post. When assembled, the post flanges and the flat section of the intermediate portion of the rail are coplanar.

14 Claims, 8 Drawing Sheets

BARRIER SYSTEM

SUMMARY OF THE INVENTION

A rail is formed from an elongate channel-shaped member having opposed first and second ends. The rail includes a first end portion situated adjacent the first end, and a second end portion situated adjacent the second end. An intermediate portion is situated between the first and second end portions. The intermediate portion and end portion include a flat section. The flat sections of the end portions are disposed in parallel, but recessed, relationship to the flat section of the intermediate portion.

A rail is formed from an elongate channel-shaped member having opposed first and second ends. The rail includes a first end portion situated adjacent the first end and a second end portion situated adjacent the second end. Each end portion is characterized by a flat section having a convex curved edge.

A post features an elongate web having a pair of laterally spaced edges. Spaced flanges are formed adjacent each edge of the web. Each flange is formed from two abutting planar sections that define a substantially double-walled structure.

BRIEF DESCRIPTION OF THE DRAWINGS

FIG. 3 is a top plan view of the post shown in FIG. 2.

FIG. 11 is a perspective view of a post and a rail.

FIG. 12 is a top plan view of the post and rail shown in FIG. 11.

DETAILED DESCRIPTION

Figure 1:
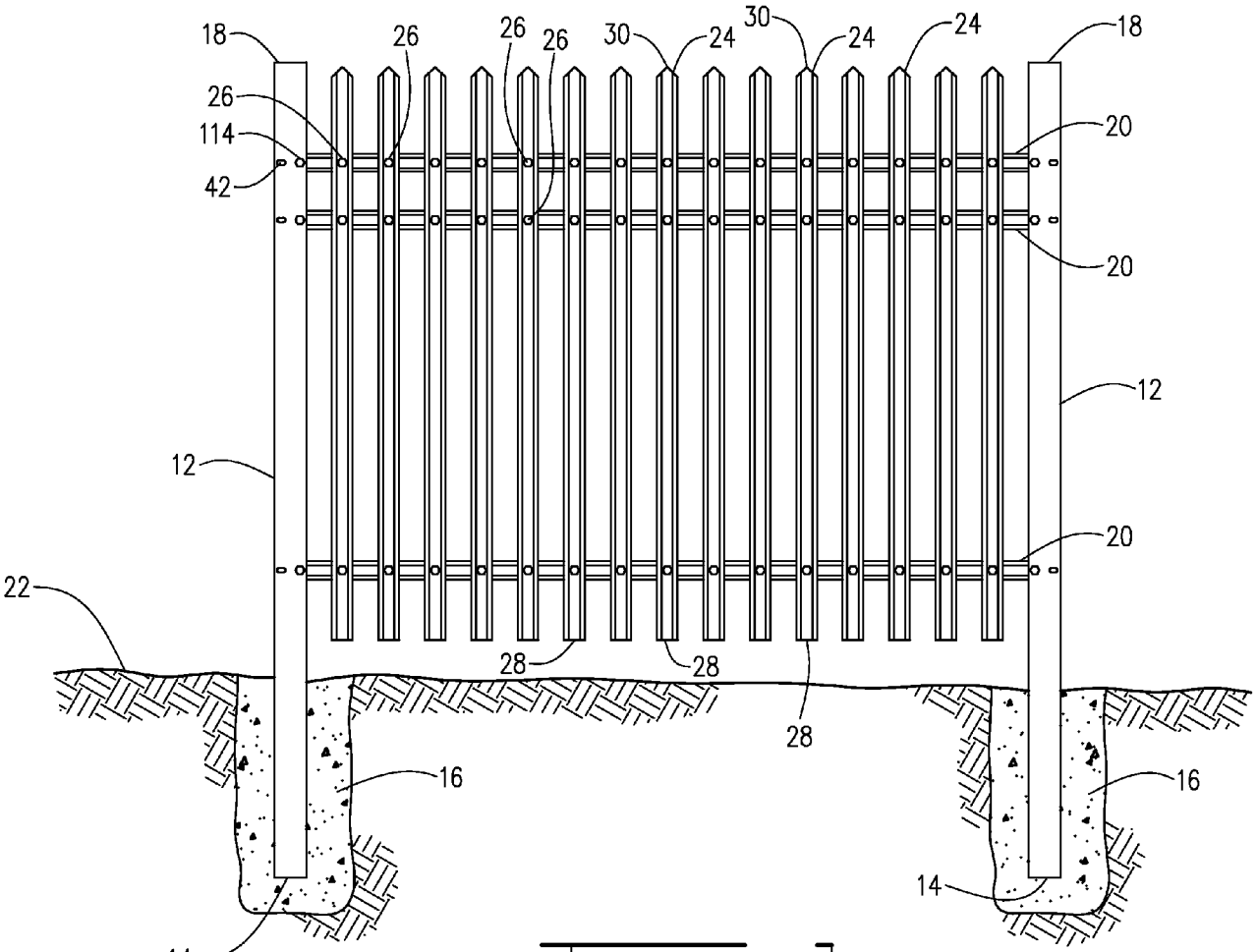
FIG. 1 is a front elevation view of a section of a barrier. The supporting terrain and substrates are shown in cross section.

FIG. 1 illustrates a barrier 10, comprising a fence. The barrier 10 is formed from a plurality of spaced vertical posts 12, two of which are shown in FIG. 1. The posts 12 are preferably identical in size, shape and construction, and each is securely anchored at its base 14 into a substrate 16, such as an underground mass of concrete. The depth of the substrate should be at least 3 feet, and may be as much as 5 feet.

The posts 12 are situated along the boundary of the area to be enclosed by the barrier 10. The post spacing should be adequate to impart strength to the barrier 10 and to securely anchor other barrier components. In one preferred embodiment, adjacent posts 12 are separated by a distance no greater than 8 feet.

The above-ground height of each installed post 12 is preferably substantially greater than the height of a human or other intruder. In preferred embodiments, the above-ground height of each post is at least 6 feet, and may be 8 feet, or as much as 10 feet. In these preferred embodiments, the total length of each post at least 9 feet, and may be as much as 13 or 15 feet.

The upper end 18 of each post 12 may be formed into a pointed or sharpened shape that will deter and hinder climbing. A spear or spike shape is acceptable for this purpose. Alternately, posts having rounded or flat tops may be used. The post 12 shown in the Figures features a flat upper end 18.

The barrier 10 further comprises a plurality of elongate rails 20, which are preferably of identical size, shape and construction. Each rail 20 is supported at its opposite ends by an adjacent pair of posts 12. At least two, and preferably three or more rails 20 extend between each adjacent pair of posts. The length of each rail 20 should be sufficient to fully span the distance between the adjacent pair of posts 12. In a preferred embodiment shown in the Figures, the length of each rail 20 is 8 feet.

The rails 20 that extend between a given pair of posts 12 are preferably disposed in parallel, vertically spaced relationship. The incline of each rail 20 should substantially match the incline of the terrain 22 on which pair of posts 12 supporting that rail 20 are installed. Thus, when the barrier 10 is positioned on horizontal terrain, as shown in FIG. 1, the rails 20 will be disposed substantially horizontally. When the barrier 10 is installed on a slanted terrain, the rail 20 is preferably tilted, or "racked," to match the terrain's slope.

With continued reference to FIG. 1, the barrier 10 may further comprise a plurality of vertically disposed pickets 24, preferably of identical size, shape and construction. Each picket 24 is supported by the vertically spaced rails 20 forming the barrier 10. A plurality of fasteners 26 are used to secure each picket 24 to its supporting rails 20. Suitable pickets for use in the barrier 10 are described in U.S. Pat. No. 6,874,767, the entire disclosure of which is incorporated by reference.

The vertical height of each picket 24 is preferably approximately equal to the vertical above-ground height of each post 12. The pickets 24 are preferably oriented in parallel relationship. The spacing between adjacent pickets 24 should be sufficiently small to prevent an intruder from traversing the gap. In one preferred embodiment, the separation distance between the centers of adjacent pickets 24 is no more than 6 inches. If a picket 24 adjoins a post 12, the post-picket spacing should be at least as small as the spacing between adjacent pickets.

Between adjacent pairs of posts 12, pickets 24 should be provided in sufficient number to assure that the picket-picket and picket-post spacing does not exceed the requisite distance. In the embodiment shown in FIG. 1, for example, 15 pickets are installed with a center-to-center separation of 6 inches.

The base 28 of each picket 24 is preferably situated no more than a small distance above the terrain 22 supporting the barrier 10. Such positioning renders it more difficult for an intruder to traverse the gap between the base of the picket 24 and the terrain 22.

The upper end 30 of each picket 24 may be formed into a pointed or sharpened shape that will deter and hinder climbing. A spear or spike shape is acceptable for this purpose. In another embodiment, the upper end of each picket can be formed in a splayed configuration that provides a plurality of spear-like protrusions. Alternately, pickets having round or flat tops may be used.

In another embodiment not shown in the Figures, a fencing fabric, such as chain link fencing fabric, may be incorporated into the barrier. The fencing fabric is attached to the rails and posts of the barrier with wire ties.

Figure 2:
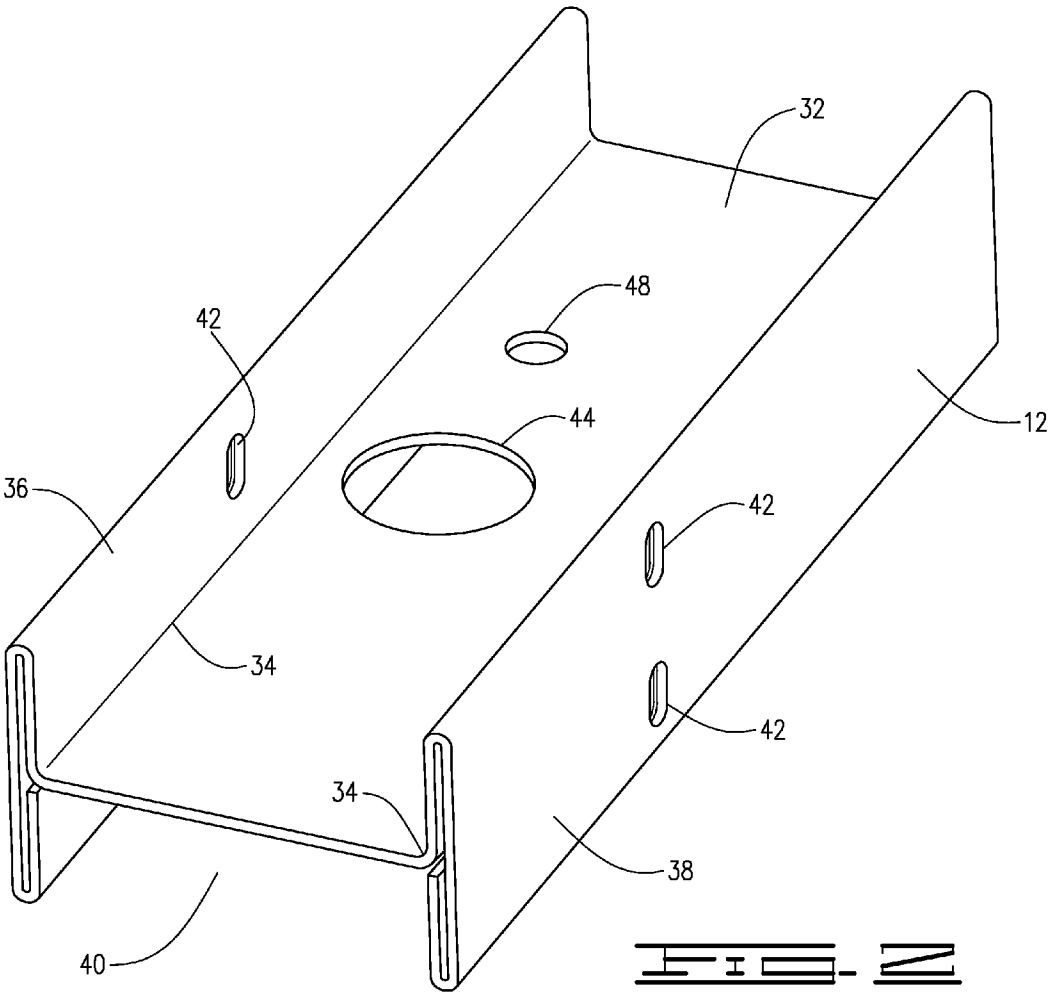
FIG. 2 is a perspective view of part of a post.

The post 12 is shown in detail in FIGS. 2 and 3. Each post 12 is preferably formed from a strong and durable material, such as a strip of sheet steel. To enhance its resistance to corrosion, this steel is preferably galvanized. In a preferred embodiment, the steel is characterized by a thickness of 0.11 inches. The galvanized steel strip undergoes a cold rolling process to produce the cross-sectional shape shown in FIG. 3. After cold rolling is complete, a polyester powder coating is preferably applied, to further enhance the post's resistance to corrosion.

Each post 12 is preferably characterized by the I-shaped cross section shown in FIG. 3. The post features a flat and elongate web 32 having a pair of laterally spaced edges 34. Spaced flanges 36 and 38 are formed adjacent each edge 34 of the web 32. The flanges 36 and 38 cooperate with the web 32 to form at least one, and preferably two channel-shaped regions 40. As shown in FIG. 2, the two channel-shaped regions 40 are separated by web 32.

The web 32 and flanges 36 and 38 preferably comprise regions of the same single piece of material, preferably a strip of sheet steel. Each flange is separated from the adjacent web 32 by a fold in the material. In one embodiment, the web 32 is 3.890 inches in width, while each of the flanges 34 and 36 is 2.735 inches in width. In another embodiment, the web 32 is 2.900 inches in width, while each of the flanges 34 and 36 is 2.735 inches in width.

Each of the flanges 36 and 38 is characterized by a substantially flat double-wall structure, while the flat web 50 is a single-walled structure. The double walls of the flanges are preferably formed by folding planar portions of steel strip into an overlapping and abutting configuration. This overlapping configuration improves resistance to corrosion and enhances the strength of the post 12.

At least one, and preferably a plurality of identically-sized fastener openings 42 are formed in each of the flanges 36 and 38. The number of fastener openings 42 formed in a given flange should be at least as great as the number of rails 20 to be attached to that flange.

Preferably each fastener opening 42 in a given flange is matched with a second opening 42 situated on the opposite side of web 32. Each opening 42 should be longitudinally positioned at a height that matches the height of one of the rails 20 to be installed in the barrier 10. Preferably, each fastener opening in each flange is matched by a fastener opening of equal height in the opposite flange of the post.

The fastener openings 42 are preferably formed by punching holes in the sheet of material from which the post 12 is formed, before it is cold-rolled. Because each flange is double-walled, two holes must be made in the material for each opening 24 formed. When the double-walled flange is formed by folding, the paired holes register and form a single fastener opening 42.

In a preferred embodiment, each fastener opening 42 is formed in an oblate shape. The major axis of the opening 42 is disposed in perpendicular relationship to the longitudinal axis of the post 12. The width of the opening 42 is 0.375 inches, and the maximum length is about 0.75 inches. The center-to-center separation distance between paired fastener openings 42 is 1.485 inches.

As shown in FIG. 2, at least one cable passageway 44 may be formed in the web 32 of the post 12. The cable passageway 44 should be sized to clearingly receive a cable 46 (shown in FIG. 9) therethrough. The number of cable passageways 44 should be at least as large as the number of cables 46 to be installed in the barrier 10. In a preferred embodiment, the diameter of the cable passageway 44 is 1.75 inches.

Each cable passageway 44 should have a longitudinal position that corresponds to the height of one of the rails 20 to be installed in the barrier 10. Like the fastener openings 42, each cable passageway 44 is preferably punched from the sheet or strip of material used to form the post 12, before that material undergoes cold-rolling.

One or more optional fastener openings 48 may be formed in the web 12, as shown in FIG. 2. The fastener opening 48 should be sized to clearingly receive a fastener therethrough, such as the bolt of a nut and bolt assembly. The number of fastener openings 48 should be at least as large as the number of rails to be attached to one side of the post. In a preferred embodiment, the diameter of the fastener opening is 0.563 inches.

As described hereafter, the fastener openings 42 are preferably used to form the rail-post connections in the barrier 10. However, in the event that a fastener opening 42 is not used to form a given rail-post connection, the fastener opening 48 may be used to form a rail-post connection. A fastener (not shown) is inserted through the opening 48 and an aligned opening in a bracket (not shown). The fastener is actuated to secure the web 32 to the bracket. A second fastener (not shown) is inserted through aligned openings in the bracket and a rail. The fastener is actuated to secure the bracket to the rail. Preferably the fasteners comprise nut and bolt assemblies.

Each fastener opening 48 should have a longitudinal position that corresponds to the height of one of the rails 20 to be installed in the barrier 10. Each fastener opening 48 is preferably punched from the sheet or strip of material used to form the post 12, before that material undergoes cold-rolling.

The rail 20 is illustrated in detail in FIGS. 4-7. Each rail 20 is an elongate channel-shaped member having a first end 50 and an opposed second end 52. The rail 20 includes a first end portion 54 situated adjacent the first end 50, and a second end portion 56 situated adjacent the second end 52. An elongate intermediate portion 58 extends between the first and second end portions 54 and 56.

The intermediate portion 58 comprises a lower section 60 and an upper section 62. These sections are joined by a planar, vertically extending flat section 64. Preferably, the lower and upper sections 60 and 62 are symmetrical about a bisecting plane 66 that extends orthogonally through the flat section 64.

Figure 10:
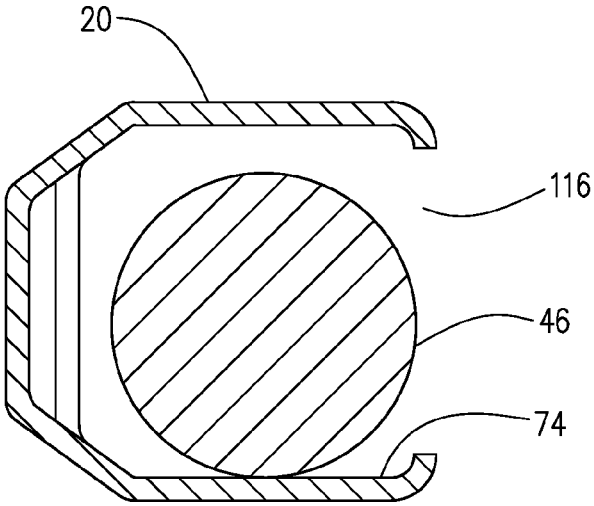
FIG. 10 is a cross-sectional view of a rail having a cable positioned within the rail channel.
Figure 7:
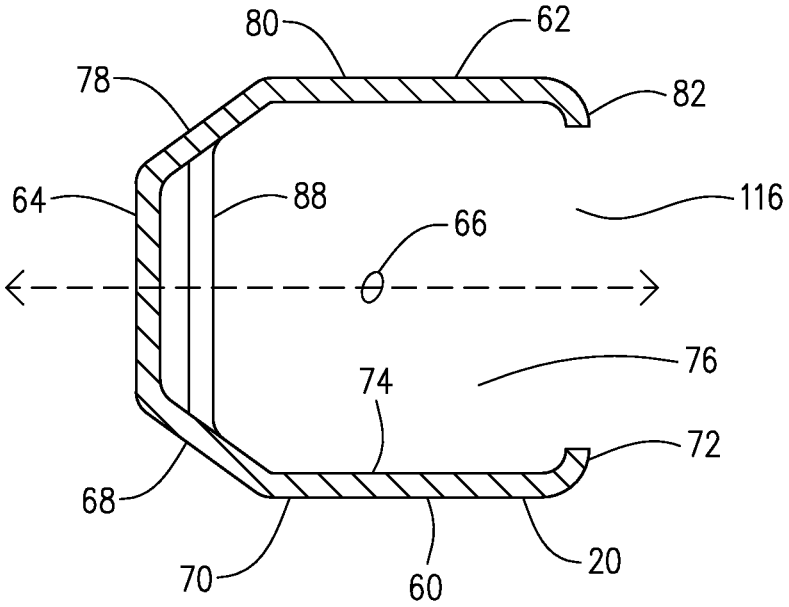
FIG. 7 is a cross-sectional view of the rail shown in FIG. 4, taken along line 7-7.

As shown in FIG. 7, the lower section 60 includes a slanted lower front wall 68, which joins the flat section 64 to a horizontally extending base wall 70. The base wall 70 in turn joins the lower front wall 68 to a vertically upturned first lip 72. The lower front wall 68 and base wall 70 are each preferably planar. The lower section 60 defines an elongate internal tray 74 that forms a lower boundary of the rail channel 76. As shown in FIG. 10, the internal tray 66 is sized to receive one or more cables 46. The cable 46 may be a strengthening, communication and/or electrical cable.

The upper section 62 includes a slanted upper front wall 78, which joins the flat section 64 to a horizontally extending top wall 80. Preferably, the top wall 80 extends in parallel relationship to the base wall 70. The top wall 80 in turn joins the upper front wall 78 to a vertically downturned second lip 82. The upper front wall 78 and top wall 80 are each preferably planar. The gap 116 between the first and second lips 72 and 82 extends the full length of the intermediate portion 58, and is sized to laterally receive a cable 46 therethrough.

In a preferred embodiment, the rail's total width is 2.143 inches and its total height is 1.974 inches. The width of the flat section 64 is 1.105 inches. The internal distance within the rail channel 76 separating the top wall 80 and the base wall 70 is 1.75 inches. The gap 116 between the first and second lips 72 and 82 has a width of 1.526 inches. The internal angle between the flat section 64 and the lower front wall 68 is 124 degrees. The internal angle between the flat section 64 and the upper front wall 78 is the same. The internal angle between the lower front wall 68 and the base wall 70 is 146 degrees. The internal angle between the upper front wall 78 and the top wall 80 is the same.

Figure 4:
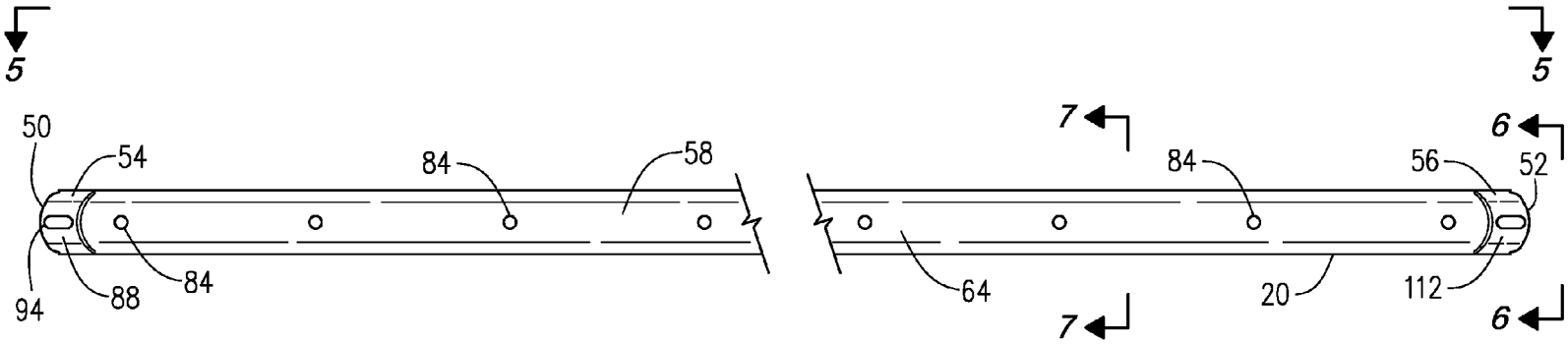
FIG. 4 is a front elevation view of a rail. A medial portion of the rail has been cut away.
Figure 5:
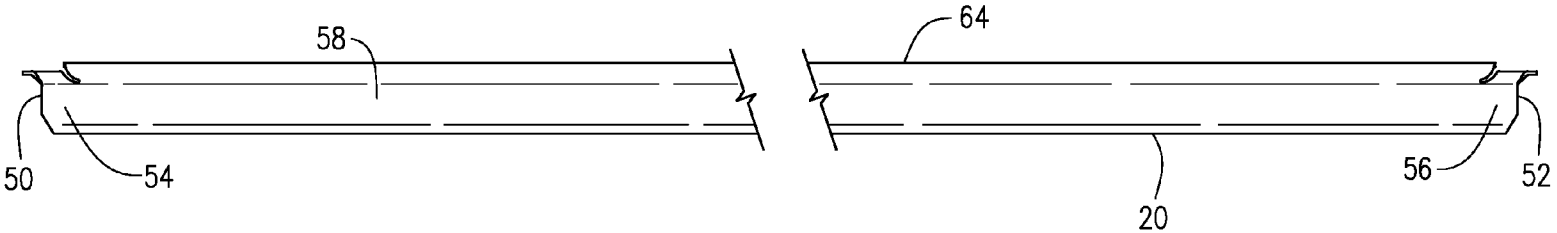
FIG. 5 is a top plan view of the rail shown in FIG. 4, taken along line 5-5.

The flat section 64 provides an attachment surface to which pickets 24 or a fencing fabric may be secured. As shown in FIG. 4, a plurality of longitudinally spaced fastener openings 84 are formed in the flat section 64. The openings 64 may be aligned with openings (not shown) formed in the pickets 24. Fasteners 26, shown in FIG. 1, are inserted through each pair of aligned openings. The fasteners 26 are then actuated to secure the picket 24 to the flat section 64. The fasteners 26 preferably comprise nut and bolt assemblies.

Figure 9:
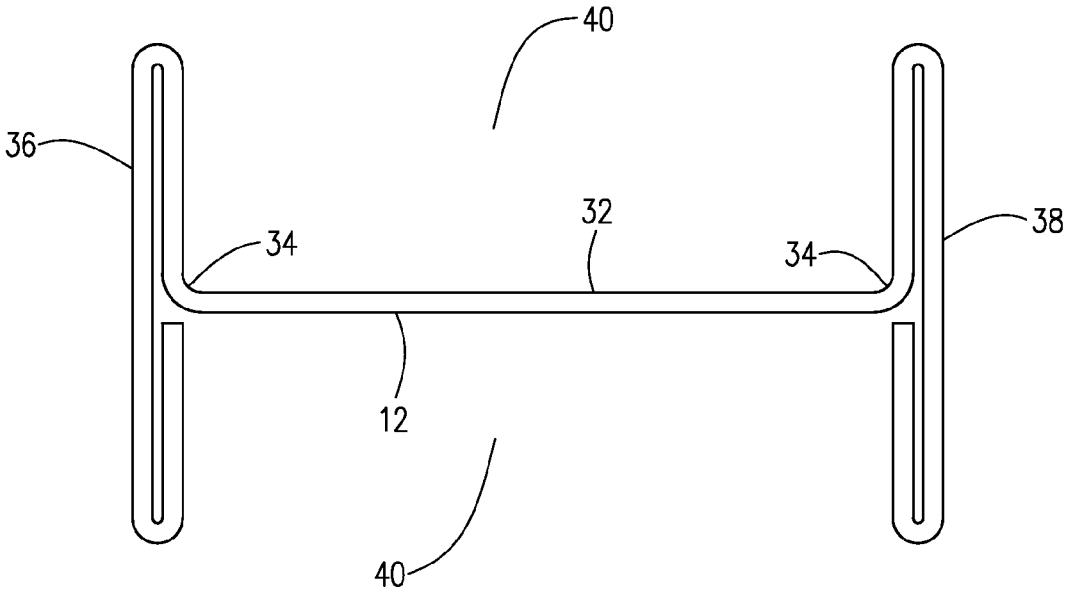
FIG. 9 is an enlarged top plan view of the first end portion of the rail shown in FIG. 4.
Figure 8:
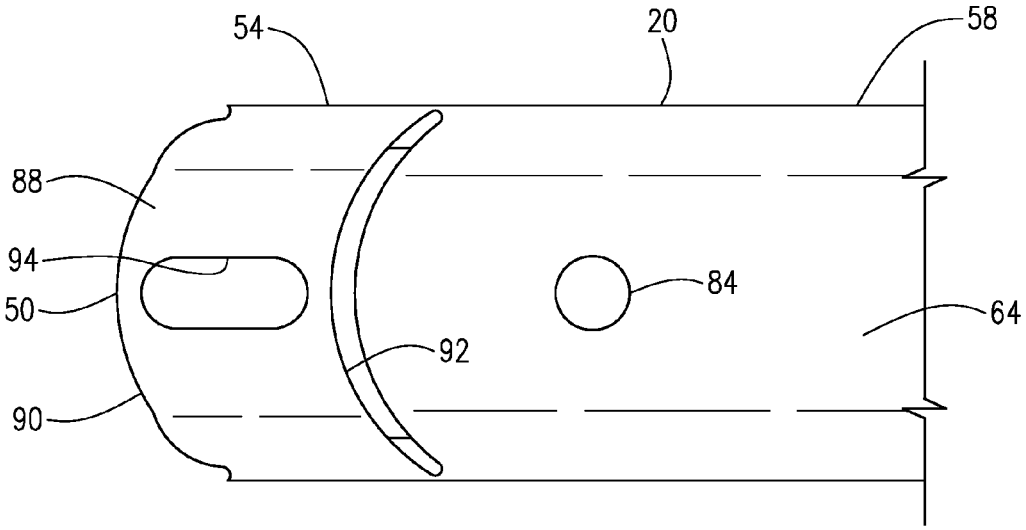
FIG. 8 is an enlarged front view of the first end portion of the rail shown in FIG. 4.
Figure 9:
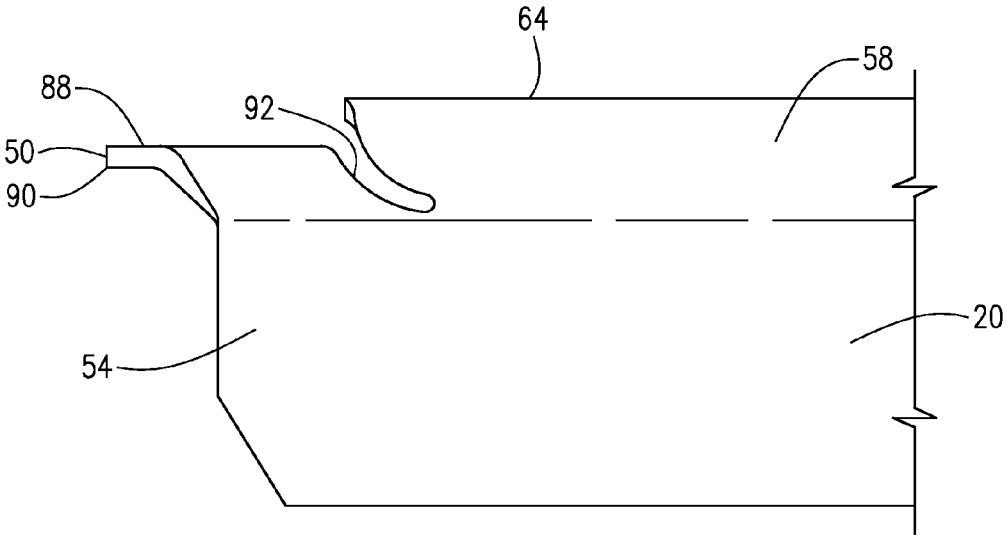
Figure 7:
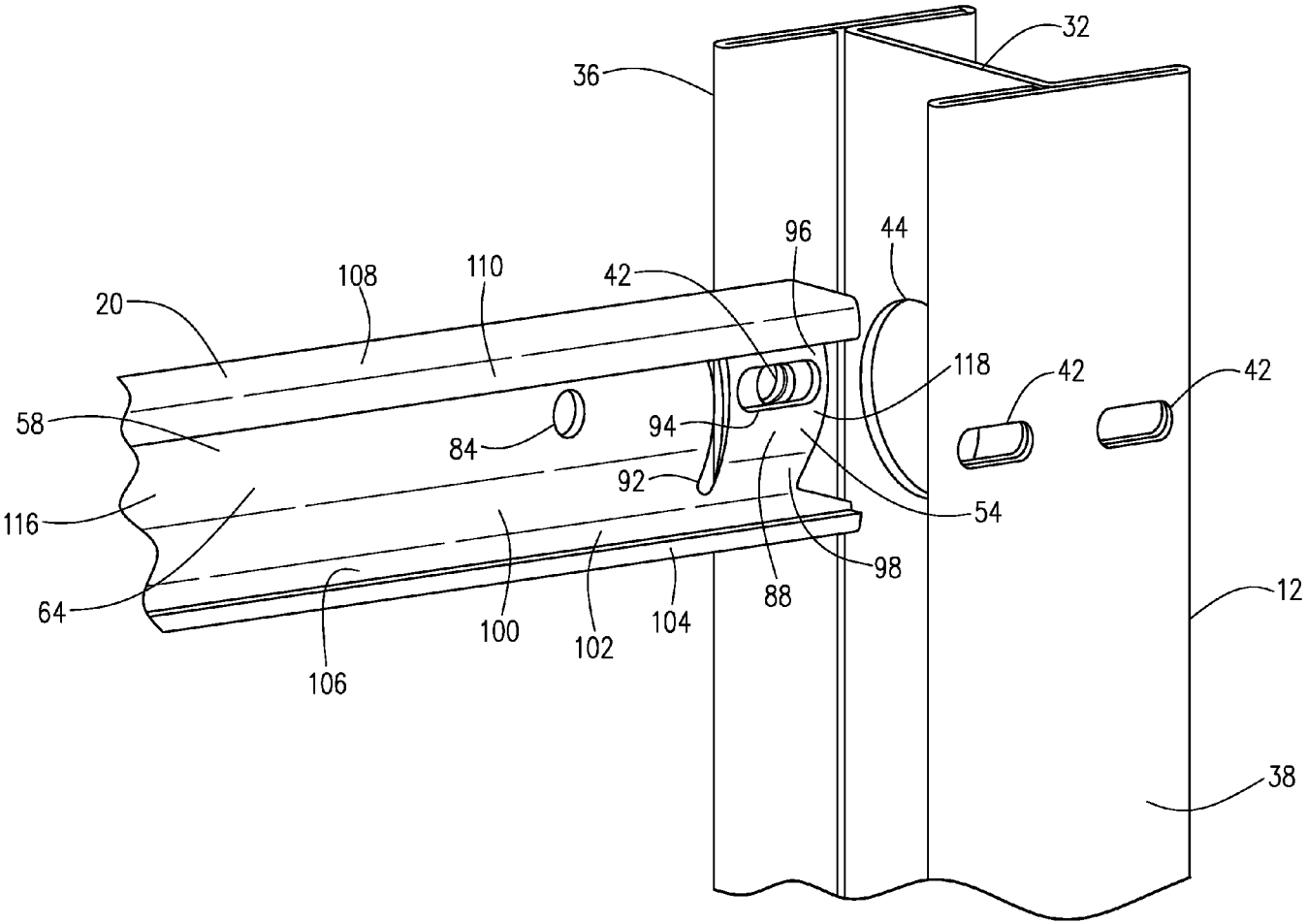
Figure 17:
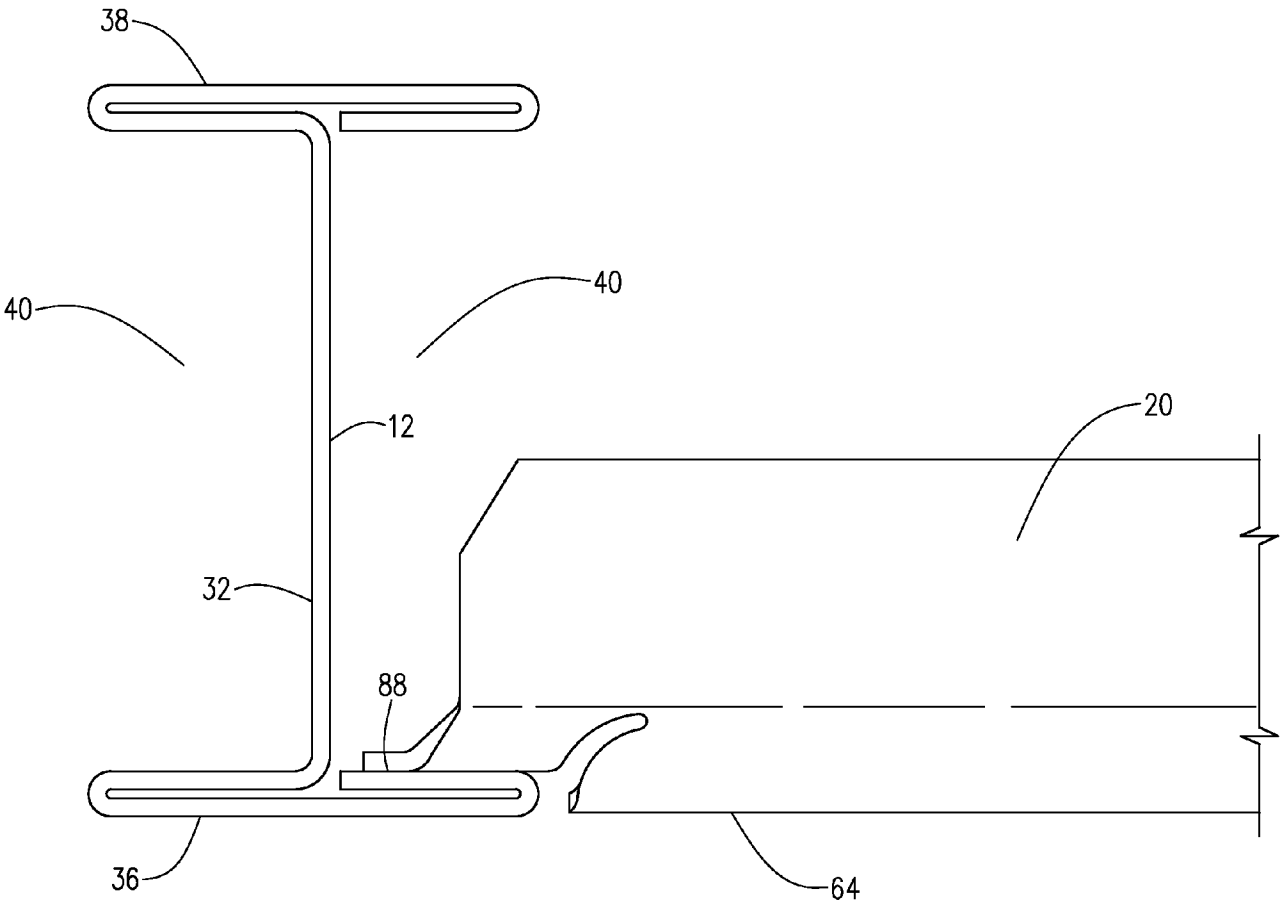

FIGS. 7-9 illustrate the first end portion 54 of the rail 20. The first end portion 54 is longitudinally bounded by a curved first edge 90 and a spaced and curved second edge 92. Preferably, the first edge 90 includes a longitudinal extremity of the rail 20, such as first end 50. As shown in FIG. 8, the shape of the first end portion 54 at the first edge 90 is convex.

The curves defined by the first and second edges 90 and 92 preferably have the same shape, and are uniformly spaced. More preferably, these curves are circular arcs having the same radius. In a preferred embodiment, the radius of the curves defined by first and second edges 90 and 92 is 1.125 inches. The separation distance between these edges is 1.125 inches.

The first end portion 54 is sized to be fully received within each channel-shaped region 40 of the post 12. The first end portion 54 includes a planar, vertically extending flat section 88 that is longitudinally bounded by the first and second edges 90 and 92. The flat section 88 is disposed in parallel, but recessed, relationship to the flat section 64 of the intermediate portion 58. In a preferred embodiment, the spacing between the respective flat sections is 0.25 inches.

A fastener opening 94 is formed in the first end portion 54, preferably in the flat section 88. The fastener opening 94 should be sized to register with a fastener opening 42 in the flange 36 of post 12. In a preferred embodiment, each fastener opening 94 is formed in an oblate shape with a major axis that extends parallel to the longitudinal axis of the rail 20. The width of the opening 94 is 0.375 inches, and its maximum length is between about 0.45 and about 0.475 inches.

As shown in FIG. 11, the first end portion 54 further comprises a lower section 96 and an upper section 98. These sections are joined by the flat section 88. Preferably, the lower and upper sections 96 and 98 are symmetrical about a bisecting plane (not shown) that extends orthogonally through the flat section 88.

The lower section 96 includes a slanted lower front wall 100, which joins the flat section 88 to a horizontally extending base wall 102. The base wall 102 in turn joins the lower front wall 100 to a vertically upturned first lip 104. The lower front wall 100 and base wall 104 are each preferably planar. As FIG. 11 illustrates, the base wall 102 is aligned with the base wall 70 of the intermediate portion 58. Similarly, the first lip 104 is aligned the first lip 72 of the intermediate portion 58. The lower section 60 thus defines an internal tray 106 joined to the internal tray 74 of the intermediate portion 58.

The upper section 98 includes a slanted upper front wall (not shown), which joins the flat section 88 to a horizontally extending top wall 108. Preferably, the top wall 108 extends in parallel relationship to the base wall 102. The top wall 108 in turn joins the upper front wall to a vertically downturned second lip 110. The upper front wall and top wall 108 are each preferably planar. As shown in FIG. 11, the top wall 108 is aligned with the top wall 80 of the intermediate portion 58. Similarly, the second lip 110 is aligned with the second lip 82 of the intermediate portion 58. The gap 118 between first and second lips 104 and 110 is aligned with the gap 116 of identical width in the intermediate portion 58.

Figure 6:
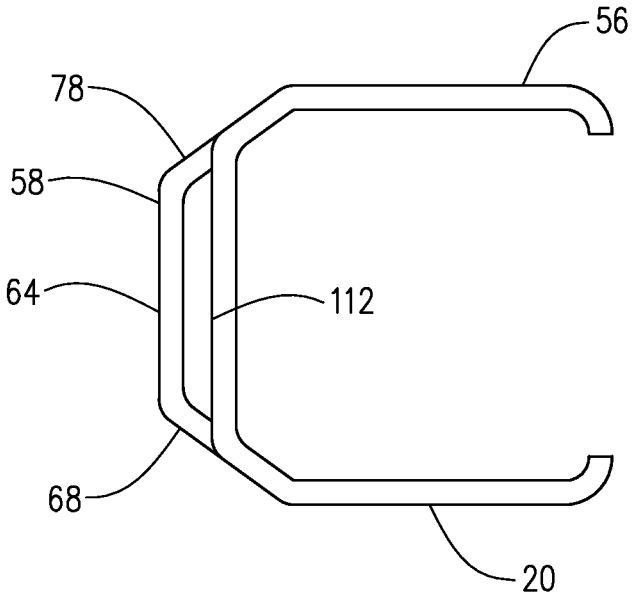
FIG. 6 is an end view of the rail shown in FIG. 4, taken along line 6-6.

The second end portion 56 of the rail 20 is formed as a mirror image of the first end portion 54. The first and second end portions 54 and 56 are otherwise identical in size, shape and construction. The flat section 112 of the second end portion 56 is shown in FIGS. 4 and 6. The flat section 112 is coplanar with the flat section 88 of the first end portion 54.

Each rail 20 is preferably formed from a strong and durable material, such as a strip of sheet steel. In a preferred embodiment, the steel is characterized by a thickness of 0.11 inches. To enhance its resistance to corrosion, this steel is preferably galvanized.

A punch press is used to form the fastener openings 84 and 94 in the galvanized steel that will be used to form the rail 20. Pairs of curved and spaced slots are next cut in the sheet. These slots correspond to the first and second edges of the first end portion 54 and the corresponding edges of the second end portion. The sheet is then subjected to a cold rolling process to produce a channel shaped member having the cross-sectional shape of intermediate portion 58. At the end of this forming process, a cut-off die depresses flat section 88 relative to flat section 64 between each pair of slots. The die simultaneously cuts away excess material to form a finished rail. After these steps are complete, a polyester powder coating is preferably applied, to further enhance the rail's resistance to corrosion.

FIGS. 11 and 12 show how the rail 20 is attached to a post 12. The first end portion 54 of the rail 20 is first inserted into the post's channel-shaped region 40. The planar flat section 88 is placed flush against the planar inner surface of flange 32, and the fastener openings 42 and 84 are aligned.

A fastener 114, shown in FIG. 1, is inserted through the aligned openings. The fastener 114 is then actuated to secure the rail 20 to the post 12. The fastener 114 preferably comprises a nut and bolt assembly.

The rail 20 is attached at its second end 52 to another post 12 that will form the barrier 10, using the same steps. Additional rails 20 are attached to posts 12 forming the barrier 10 in the same way.

If the barrier 10 includes a cable 46, the cable 46 is laterally inserted into a rail 20 through longitudinal opening 116 and extended internally within the rail's channel 76. One end of the cable 46 is passed through the cable passageway 44 of the adjoining post 12. The cable 46 is then drawn through the passageway 46 and positioned within the channel 76 of adjoining rail 20. The cable 46 may be extended through additional posts, and positioned within additional rails, in the same way. Preferably, the cable 46 rests in the tray of each portion of each rail 20.

The end portions of the rail 20 are fully contained within the channel-shaped regions 40 of the posts 12. Because of this positioning, the rail 20 does not protrude from the barrier 10. This allows the flanges 26 of each adjacent pair of posts 12 to assume a coplanar relationship with the flat sections 64 of the rails 20 that interconnect them. These coplanar surfaces allow a fencing fabric to form a close and conforming fit with the rails 20 and posts 12 of the barrier 10.

The elongated fastener openings 42 and 92 allow minor adjustments in the position of the rails 20 relative to the posts 12. The convexly curved, rounded edge at the end of each rail 20 allows the rail to be tilted without interference from the planar surfaces of the post's channel-shaped region 40. This facilitates racking of the rail to conform to the slope of the terrain.

The barrier 10 may be assembled from a kit. Such a kit should include a plurality of posts, preferably identical to the posts 12. The posts 12 are preferably provided in a number sufficient to form the barrier, or a section thereof.

The kit further comprises a plurality of rails, each preferably identical to the rail 20. Each such rail should be assemblable into a barrier that traverses the space between an adjacent pair of posts 12. The rails 20 should be provided in a number sufficient to form the barrier, or a section thereof.

The kit preferably further comprises a plurality of fasteners, for securing the rails 20 to the posts 12. The fasteners should be provided in a number sufficient to permit assembly of the posts 12 and rails 20 required to form the barrier, or a section thereof.

The kit may further comprise a plurality of pickets, preferably identical to the pickets 24, and a plurality of fasteners, for securing the pickets to the rails 20. The pickets and fasteners should be provided in a number sufficient for the barrier, or a section thereof.

The kit may also comprise a quantity of fencing fabric, and a plurality of fasteners, for securing the fencing fabric to the rails 20 and posts 12. The fencing fabric and fasteners should be provided in an amount sufficient to cover the barrier, or a section thereof.

The kit may further comprise one or more cables 46. Each cable should be extendable within the internal trays of any of the rails 20 of the kit.

Changes may be made in the construction, operation and arrangement of the various parts, elements, steps and procedures described herein without departing from the spirit and scope of the invention as described in the following claims.

The invention claimed is:

1. A rail having opposed first and second ends, comprising:

an elongate member having an open-ended channel that extends between the opposed ends, the channel having a base and opening laterally at a longitudinally extending gap situated opposite the base, comprising:

a first end portion situated adjacent the first end;

a second end portion situated adjacent the second end; and an intermediate portion situated between the first and second end portions and having a flat section;

in which each end portion is characterized by a flat section situated in non-touching relationship to the gap and having a convex curved edge and in which the flat section of each end portion is disposed in parallel, but recessed, relationship to the flat section of the intermediate portion.

2. The rail of claim 1 in which the curved edge includes a longitudinal extremity of the rail.

3. The rail of claim 1 in which the curve defined by the edge is a circular arc.

4. The rail of claim 1 in which the flat section of the intermediate portion is characterized by a convex curved edge at each end thereof.

5. The rail of claim 1, further characterized as formed from a single piece of material.

6. A kit, comprising:

a plurality of rails, as defined in claim 1; and a plurality of posts, each post adapted for interconnection with at least one of said rails.

7. The kit of claim 6, further comprising:

a plurality of pickets.

8. A barrier comprising a plurality of rails, as defined in claim 1, and further comprising:

a plurality of vertically disposed posts;

in which at least two rails are disposed in vertically spaced relationship between each adjacent pair of posts, and with each rail supported at its opposite ends by an adjacent pair of posts.

9. The barrier of claim 8 in which the channels of each of the plurality of rails open in the same direction.

10. A kit, comprising:

a plurality of rails, as defined in claim 4; and a plurality of posts, each post comprising:

an elongate web having a pair of laterally spaced edges; and spaced elongate flanges formed adjacent each edge of the web, the flanges cooperating with the web to form at least one laterally open channel-shaped region;

in which the recessed flat section of each end portion of each rail is sized to be fully received within each channel-shaped region of each post.

11. The kit of claim 10 in which each post is characterized by an I-shaped cross-section.

12. A barrier comprising a plurality of rails, as defined in claim 1, and further comprising:

a plurality of vertically disposed posts, each post comprising:

an elongate web having a pair of laterally spaced edges; and spaced elongate flanges formed adjacent each edge of the web, the flanges cooperating with the web to form at least one laterally open channel-shaped region;

in which at least two rails are disposed in vertically spaced relationship between each adjacent pair of posts, with each rail supported at its opposite ends by an adjacent pair of posts, and in which the flat section of the intermediate portion of each of said plurality of rails is coplanar with a flange of each of its adjoining posts.

13. The barrier of claim 12 in which the channels of each of the plurality of rails open in the same direction.

14. The barrier of claim 12 in which each post is characterized by an I-shaped cross-section.

* * * * *